United States Patent [19]

Fujino et al.

[11] 4,260,866

[45] Apr. 7, 1981

[54] REMOTE OPERATION DEVICE

[75] Inventors: Hitoshi Fujino, Furukawa; Kotaroh Tsutsui, Yokohama, both of Japan

[73] Assignee: Alps Electric Co., Ltd., Tokyo, Japan

[21] Appl. No.: 33,574

[22] Filed: Apr. 27, 1979

[30] Foreign Application Priority Data

Apr. 29, 1978 [JP] Japan ..... 53-57133[U]

[51] Int. Cl.[3] ..... H01H 3/00

[52] U.S. Cl. ..... 200/331

[58] Field of Search ..... 200/330, 331, 337, 338, 200/340, 329, 17 R, 18 R, 294, 303; 308/3 R; 74/501 R

[56] References Cited

U.S. PATENT DOCUMENTS

| | | | |
|---|---|---|---|
| 2,759,773 | 8/1956 | Wilmer et al. | 308/3.6 |
| 3,126,757 | 3/1964 | Cadwallader | 74/501 |
| 3,360,306 | 12/1967 | Vargady | 74/501 |
| 3,422,720 | 1/1969 | Johnson | 84/435 |
| 3,981,553 | 9/1976 | Gutner | 312/347 |
| 4,060,291 | 11/1977 | Seybold | 308/241 R |
| 4,121,063 | 10/1978 | Aimi | 200/18 R |

FOREIGN PATENT DOCUMENTS 51-65258 5/1976 Japan .

*Primary Examiner*—John W. Shepperd

*Attorney, Agent, or Firm*—Guy W. Shoup; Gerard F. Dunne

[57] ABSTRACT

A remote operation device for interconnecting moving portions of spaced electric components by means of a resilient interconnection member which enables remote operation of one the electric components by actuation of the other. The device includes blocks connected removably to respective ends of the interconnection member and each adapted to be connected removably to respective ones of the spaced electric components.

8 Claims, 7 Drawing Figures

REMOTE OPERATION DEVICE

The present invention relates to an operation device for interconnecting moving portions of spaced electric components whereby one of the electric components can be operated remotely by actuation of the other.

Devices such as those described in co-pending U.S. applications Ser. No. 949,776 filed Oct. 10, 1978 and Ser. No. 970,642 filed Dec. 18, 1978, and in the prior art reference Japanese Utility Model Publication No. 65258/1976, have the remote operation device connected integrally with the spaced electric components to form a unit.

Often, however, it is desired to change the spacing between the electric components and this typically required replacement of the entire unit. This not only increases the costs of changing the spacing between the electric components, but also requires that many such units, differing only by the spacing between the electric components, be kept on hand. Thus a large inventory of units must be maintained, further increasing costs and making management of production troublesome.

The present invention therefore provides a remote operation device wherein the spacing between the electric components may be changed easily.

Further objects, features and advantages of the present invention will become readily apparent from the following detailed description of a preferred embodiment thereof and accompanying drawings, in which.

DESCRIPTION OF THE PREFERRED EMBODIMENTS

Figure 1:
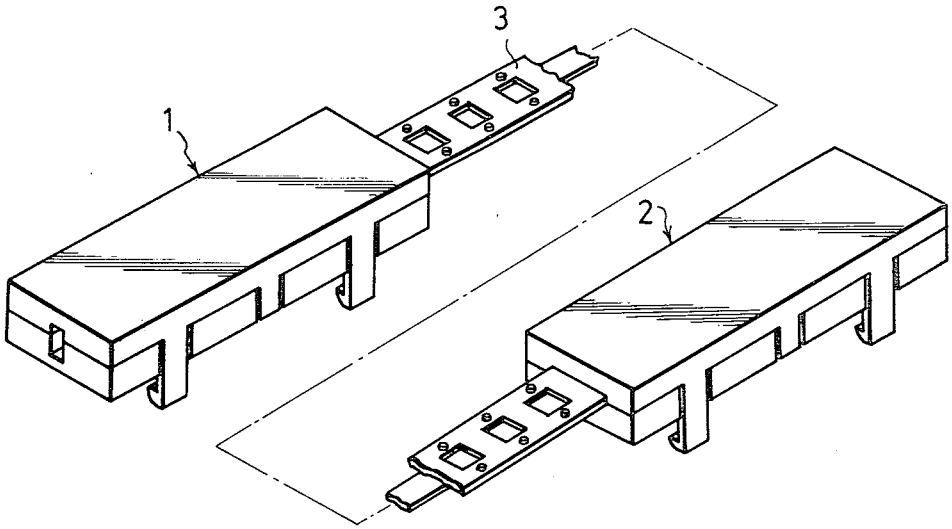
FIG. 1 is a perspective view showing an embodiment of the remote operation device in accordance with the present invention.
Figure 2:
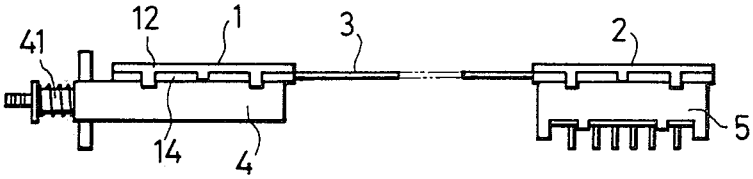
FIG. 2 is a front view of the embodiment of FIG. 1.

The remote operation device in accordance with the present invention generally comprises connection members 1 and 2 and an interconnection member 3 interconnecting the connection members as shown in FIG. 1. The connection member 1 is adapted to be combined with an operation section 4 and the connection member 2 is adapted to be combined with a slide switch 5, as shown in FIG. 2.

Figure 3:
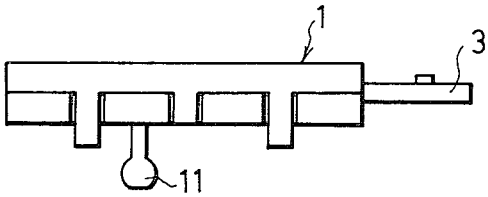
FIG. 3 is a front view of the connection member in accordance with the present invention.

As illustrated in FIG. 3, in combining the connection member 1 with the operation section 4, an engaging projection 11 protruding from the lower face of the connection member 1 is fitted into a connection groove (not shown) formed on an operation rod 41 which is slidably disposed inside the operation section 4. An engaging projection similar to that of the connection member 1 also protrudes from the lower face of the connection member 2 to operate a slide element of the slide switch 5 when the connection member 2 is joined to the slide switch 5. When an operation rod 41 is pushed, the engaging projection 11 of the connection member 1 is also caused to slide in interlocking arrangement therewith. One end of a slide member slidably incorporated inside the interconnection member 3 is operatively connected to the engaging projection 11 and its other end is operatively connected to the engaging projection of the connection member 2. Accordingly, when the engaging projection 11 slides, its motion is transmitted to the slide switch 5 whereby the slide switch 5 can be oeprated remotely.

Figure 4:
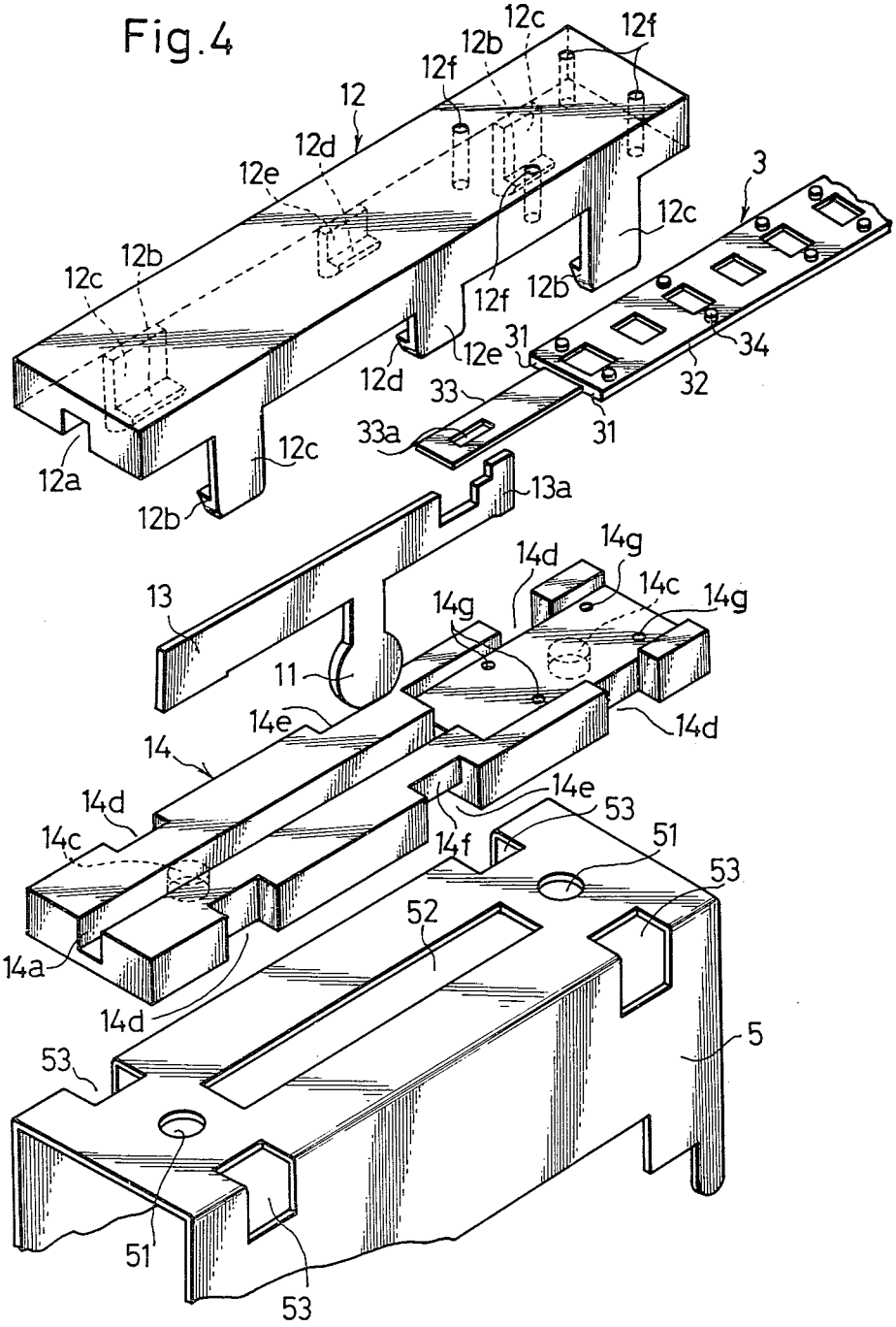
FIG. 4 is an exploded perspective view of the connection member in accordance with the present invention.

FIG. 4 is an exploded perspective view of a connection member wherein reference numeral 12 designates an upper stationary housing, which is formed in a plate-like form from a synthetic resin. A groove **12*a* runs along the lower face of this housing 12 in its longitudinal direction. Four fastening legs 12*c*, each carrying a fastening pawl 12*b*, depend downwardly from the end portions of respective longitudinal sides of the lower face of the housing 12, and two fastening legs 12*e*, each carrying a fastening pawl 12*d*, also depend downwardly from opposing central portions of the longitudinal sides of the lower face. The four fastening legs 12*c* are longer than the two fastening legs 12*e*. Four cylindrical apertures 12*f* are formed in one end portion of the upper stationary housing 12** to penetrate therethrough from its upper face to its lower face.

Reference numeral 13 represents a movable plate which is formed by punching out a metallic plate into a generally T-shape and has the aforementioned engaging projection 11 at its lower end. A caulking section **13*a* is formed on one side of this movable plate 13**.

Reference numeral 14 designates a lower stationary housing molded from a synthetic resin in a plate-like form. A groove **14*a* is defined on the upper face of the lower stationary housing 14 in its longitudinal direction and a part of the groove has a slot 14*b* formed in the bottom thereof so as to penetrate through the lower stationary housing 14 down to its lower face (see FIG. 5). Locating projections 14*c* are respectively formed to depend from the end portions of the lower face. Reference numeral 14*d* represents recesses formed in the end portions of each longitudinal side of the lower stationary housing while 14*e* represents recesses formed at the central portions of respective sides. A step portion 14*f* is formed inside each recess 14*e* and this step portion ends above the lower face of the lower stationary housing 14. Reference numeral 14*g* represents cylindrical apertures formed on one end portion of the lower stationary housing 14**.

The interconnection member 3 comprises a guide or sleeve member 32 made into a tubular trapezoidal shape from a resilient synthetic resin and has outer wires 31 embedded respectively into the longitudinal sides to run therealong. A slide member 33 is slidably inserted into the center of the guide member 32. Plural locating projections 34 are respectively formed on both the upper and lower surfaces of the guide member 32.

Next, assembly of the connection member 1 and the interconnection member 3 is made in the following manner.

After the caulking section **13*a* of the movable plate 13 is fitted into the aperture 33*a* formed at an end portion of the slide member 33 which is inserted into the interconnection member 3, the caulking section 13*a* is caulked to thereby integrate the movable plate 13 to the slide member 33. The movable plate 13 is then fitted into the groove 14***a* of the lower stationary housing 14 and the engaging projection 11 at the lower end of the moving plate 13 is inserted through the slot 14*b* so that the engaging projection 11 protrudes from the lower face of the lower stationary housing 14. In this instance, the first four locating projections 34 formed on the lower face of the guide member 32 are fitted into the cylindrical apertures 14*g*.

Next, the upper stationary housing 12 is fitted onto the lower stationary housing now carrying the movable plate 13 and the interconnection member 3 from thereabove and the fastening legs 12*c* are fitted into respective recesses 14*d*. When the upper and lower stationary housings 12 and 14 are strongly pushed in their engaging direction, the fastening legs 12*e* are fitted into the recesses 14*e* and the fastening pawls 12*d* are fitted snapwise into the steps 14*f*, thereby integrating the upper and lower stationary housings 12 and 14 together. The fastening legs 12*c*, however, extend below the lower face of the housing 12. In this instance, the movable plate 13 is loosely fitted into the groove 12*a* of the upper stationary housing 12 and the first four locating projections 34 formed on the upper face of the guide member 32 are fitted into the cylindrical apertures 12*f* of the upper stationary housing 12.

Figure 5:
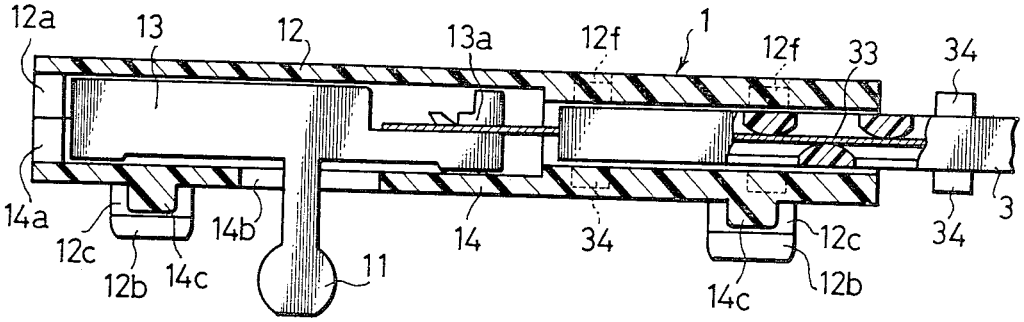
FIG. 5 is a sectional side view of the connection member in accordance with the present invention.

FIG. 5 is a sectional view showing the connection member 1 and the interconnection member 3 assembled to one another in the abovementioned manner. Incidentally, the connection member 2 has exactly the same construction as the connection member 1 and is connected to the other end of the interconnection member 3 in the same way as mentioned above.

Figure 6:
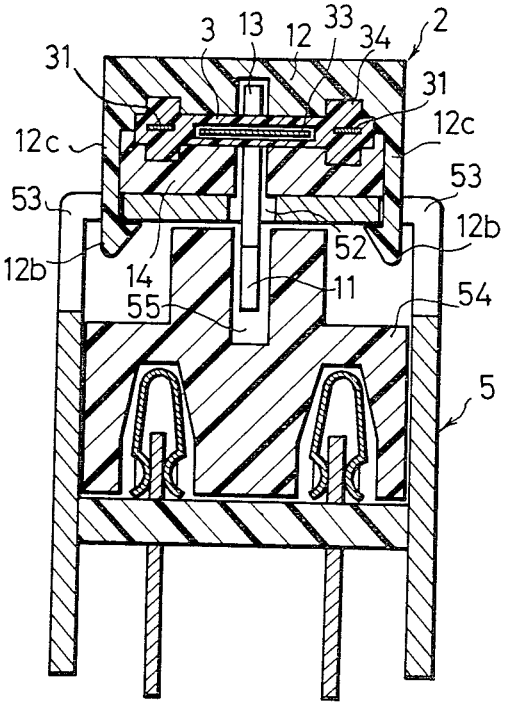
FIG. 6 is a sectional view showing the state where the connection member of the present invention is fitted to a slide switch.

After the connection member 2 of the remote operation device assembled in this manner is placed over the slide switch 5, the locating projections 14*c* of the connection member 2 are fitted within complementary locating apertures 51 formed on the slide switch 5 and the engaging projection 11 protruding from the lower face of the connection member 2 is inserted into the slit 52 of the slide switch 5 (see FIGS. 4 and 6). The engaging projection 11 is further fitted into a connection groove 55 of a slide element 54 of the slide switch 5 and the connection member 2 is then pushed in the direction of the slide switch 5 whereby the locating projections 14*c* are fitted into the locating apertures 51 and the fastening legs 12*c* protruding downward from the connection member 2 are fitted into the slots 53 of the slide switch 5 so that the fastening pawls 12*b* at the tips of the fastening legs 12*c* are anchored to the edge of the slots 53, thereby integrating the connection member 2 with the slide switch 5. FIG. 6 is a sectional view showing the state where the connection member 2 and the slide switch 5 are mutually integrated. The connection between the connection member 1 and the operation section 4 is also made in the same way.

Incidentally, when the fastening pawls 12*b* anchored to the slots 53 are removed therefrom by the use of the tip of a screw driver or the like, the electric component can easily be separated from the connection member.

The upper stationary housing 12 can also be separated easily from the lower stationary housing 14 by releasing the engagement between the fastening legs and the recesses 14*e* in a similar manner.

Figure 7:
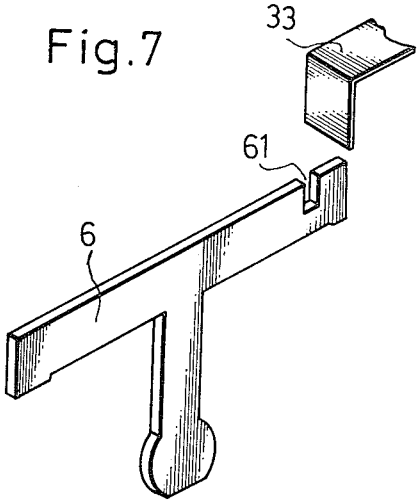
FIG. 7 is a perspective view showing the state of another example where the moving plate of the connection member of the present invention is fastened to a slide member of the interconnection member.

Though the slide member 33 of the interconnection member 3 and the movable plate 13 are integrated with each other by caulking in the above-decribed embodiment, integration may alternatively be made by forming a vertical slot 61 on one side of a movable plate 6 and bending one end of the slide member 33 so as to fit that bent end into the slot 61, as shown in FIG. 7. If this construction is used, the distance of remote operation can be changed extremely easily because the interconnection member, when produced in an elongated size, can be cut off in a desired length and be esily fitted to the connection member.

Though the operation section is of a push-button type in the abovementioned embodiment, it may of course be of a slide type. Further, the electric component to be remote-operated is not particularly limited to a slide switch but may also be various other components such as a slide type variable resistor, for example.

As explained in detail in the foregoing paragraphs, since the remote operation device can be removed easily from the operation section and the electric component in accordance with the present invention, it becomes unnecessary to replace the electric component as well as the operation section for changing the remote operation distance as in other devices. In other words, only the length of the interconnection member of the remote operation device of the present invention need be changed to alter the distance of remote operation and this is possible in a simple manner. Further, even when the remote operation device is out of order during use, it is not necessary to change any electric component and only the remote operation device need be replaced. Hence, repairing is also simple.

Fastening of the connection member to the electric component or to the operation section can be made simply by fitting the respective fastening legs into their respective mating recesses. Location of the connection member is made by fitting its locating projections into the locating holes of the electric component or of the operation section and also by fitting the projections of the interconnection member into the mating round apertures of the upper and lower stationary housings so as to clamp the interconnection member between these stationary housings. Accordingly, deviation of the relative position is eliminated between the connection member and the interconnection member and remote operation has extremely high accuracy.

Further, the upper stationary housing can easily be integrated with the lower stationary housing by fitting the fastening legs of the former into the recesses of the latter and hence, assembly of the remote operation device can be made extremely easily.

What is claimed is:

1. In a remote operation device for interconnecting spaced electric components for operating one of said components by remote actuation of the other, comprising a resilient interconnection member for interconnecting said spaced electric components, said interconnection member including a sleeve member and a slide member extending slidably therein; and first and second connection members each adapted to be secured detachably to respective ones of said components and including a movable plate secured to the respective end of said slide member and having a portion engaging the operation portion of the respective component the improvement wherein said first and second connection members each include an upper housing and a lower housing fitted together detachably for holding the respective end of said interconnection therebetween, each said upper housing having at least one first fastening member formed integrally thereon for fastening said upper housing detachably to said lower housing, and at least one second fastening member formed integrally on each of said upper housings for fastening the connection members detachably to the respective electric component held against said lower housing.

2. A remote operation device according to claim 1, said lower housings each being adapted to fit on the respective electric component and including a longitudinal slot formed therein, and said movable plates each having a portion depending through the respective slot for engaging the operation portion of the respective component.

3. A remote operation device according to claim 1, said lower housings each being adapted to fit on the respective electric component and including projections adapted to fit within aligning holes formed within the respective electric component.

4. A remote operating device according to claim 1, the inner faces of said upper and lower housing each having recesses adapted to receive aligning projections on said sleeve member.

5. A remote operating device according to claim 1, said movable plates each having a portion adapted to be secured to a respective end of said slide member by caulking.

6. A remote operating device according to claim 1, said upper housings each including two of said first fastening members each located centrally along a respective longitudinal side of said upper housing and adapted to engage side portions of the respective lower housing.

7. A remote operating device according to claim 6, said upper housings each having two of said second fastening members located on either side of each said first fastening members said second fastening members being longer than said first fastening members and adapted to engage the respective electric component.

8. A remote operating device according to claim 1, each said second fastening member being longer than any first fastening member.

* * * * *